United States Patent [19]

Halls

[11] Patent Number: 4,867,092

[45] Date of Patent: Sep. 19, 1989

[54] RUDDER ASSEMBLY

[76] Inventor: Gary L. Halls, 567 E. Jackson St., New Holland, Pa. 17557

[21] Appl. No.: 268,206

[22] Filed: Nov. 7, 1988

[51] Int. Cl.[4] ..... B63H 25/06

[52] U.S. Cl. ..... 114/162; 114/39.1; 114/165

[58] Field of Search ..... 114/39.2, 162, 163, 114/165, 126, 167, 39.1; 244/88; 446/160

[56] References Cited

U.S. PATENT DOCUMENTS

| | | | |
|---|---|---|---|
| 360,488 | 4/1887 | Sweeney | 114/163 |
| 1,295,732 | 2/1919 | Grahm | 114/163 |
| 2,653,563 | 9/1953 | Long | 114/162 |
| 2,726,621 | 12/1955 | Hill | 114/162 |
| 2,858,788 | 11/1958 | Lyman | 114/126 |
| 3,515,089 | 6/1970 | Taggart | 114/162 |
| 3,580,208 | 5/1971 | Hinckley | 114/163 |
| 3,793,731 | 2/1974 | Hyyppa | 114/162 |
| 3,902,442 | 9/1975 | Bech | 114/39.2 |
| 4,027,614 | 6/1977 | Jones | 114/163 |
| 4,100,874 | 7/1978 | Wright | 114/162 |

*Primary Examiner*—Joseph F. Peters, Jr.

*Assistant Examiner*—Edwin L. Swinehart

*Attorney, Agent, or Firm*—Larry W. Miller

[57] ABSTRACT

A rudder assembly for use on a sailing vessel is disclosed wherein the rudder is bifurcated into a pair of downwardly diverging rudder vanes rotatably mounted on support arms extending transversely of the tiller post. As the sailing vessel is tipped sideways, one of the rudder vanes approaches a generally vertical orientation while the other rudder vane approaches a generally horizontal orientation. A restraining member is pivotably mounted on a mounting post affixed to the tiller post for movement therewith and is engageable with the rudder vanes to restrict movement thereof away from a stop member. The restraining member is pivotally movable by gravity to disengage the rudder vane approaching a horizontal orientation and permit rotative movement thereof away from the stop member to that a rotation of the tiller post to turn the rudder into the direction the sailing vessel is tipped sideways will not create forces that tend to further tip the sailing vessel, leaving the rudder vane approaching a vertical orientation operable to steer the sailing vessel.

26 Claims, 4 Drawing Sheets

RUDDER ASSEMBLY

BACKGROUND OF THE INVENTION

The present invention relates generally to-marine vessels, such as sailboats, and, more particularly, to a rudder assembly for use with such vessels to control the direction of travel.

Rudders are used on marine vessels to deflect water passing thereby and create sufficient forces to cause a change of direction of the vessel. Sailboats often tip sideways when tacking into the wind or encountering a beam reach situation in which the wind is blowing perpendicularly to the direction of travel of the sailboat, causing the rudder to move from a generally vertical orientation to one that is inclined toward horizontal. This situation can also develop when a squall is suddenly encountered, creating a knockdown effect which can cause a single rudder to be positioned out of the water where no control over the sailboat can be exerted, particularly if sufficient wind is blowing to keep the bow of the boat down.

When the rudder is inclined in this manner, it is less efficient at effecting a change in direction of the vessel. An inclined single rudder will act like an elevator on an airplane rather than a rudder. Consequently, a turning of the rudder into the direction in which the vessel is tipped will create forces due to the downward deflection of the water that would tend to further tip the vessel. This problem of controlling the direction of travel of a marine vessel when the rudder is not vertically oriented is common to large sailboats and other similar marine vessels as well as to small boats, such as remote, radio controlled model boats.

Accordingly, it would be desireable to provide a rudder assembly for a sailing vessel that would be more effective at changing the direction of travel of the vessel under conditions where the vessel is tipped sideways.

SUMMARY OF THE INVENTION

It is an object of this invention to overcome the aforementioned disadvantages of the prior art by providing a rudder assembly that will have a rudder component positioned generally vertically when the marine vessel on which it is used becomes tipped sideways.

It is another object of this invention to provide a rudder assembly having a bifurcated rudder in which a pair of rudder vanes are positioned angularly with respect to each other.

It is a feature of this invention that the rudder vanes diverge downwardly away from the tiller post, extending transversely such that neither of the rudder vanes are positioned vertically under upright operating conditions.

It is an advantage of this invention that a sideways tipping of the sailing vessel will tend to orient one of the rudder vanes into a generally vertical orientation.

It is still another object of this invention that the rudder assembly is provided with a restraining member that will disengage a rudder vane approaching a generally horizontal orientation due to a sideways tipping of the sailing vessel and prevent the generally horizontal rudder vane from turning with the tiller post in the direction the vessel is tipped.

It is another feature of this invention that the restraining member keeps the rudder vane approaching a generally vertical orientation in an operative mode so that it will be effective to cause a change in direction of the sailing vessel.

It is another advantage of this invention that the movement of one of the rudder vanes toward a generally vertical orientation due to a sideways tipping of a sailing vessel provides an effective rudder for changing the direction of travel of the sailing vessel without incurring forces tending to further tip the vessel.

It is still another feature of this invention that the restraining member is pivotally mounted to a mounting post so that gravity will effect a movement thereof to disengage the upper rudder vane when the sailing vessel tips sideways.

It is yet another object of this invention to affix the support arms rotatably mounting the rudder vanes and the mounting post pivotally mounting the restraining member to the tiller post to be rotatable therewith.

It is yet another feature of this invention that the mounting post also provides a stop member positioned between the two diverging rudder vanes to prevent each rudder vane from moving into the path of movement of the other rudder vane.

It is a further feature of this invention that the restraining member restrains the movement of the rudder vane away from the stop member when in a restraining position.

It is still another advantage of this invention that the restraining member is operable to fix both rudder vanes against the stop member when the sailing vessel is in an upright position so that both rudder vanes will deflect water to exert forces for changing the direction of travel of the sailing vessel.

It is still a further feature of this invention that the restraining member is provided with a pair of rearwardly diverging legs that engage respective rudder vanes to restrict movement thereof when the restraining member is in a restraining position relative thereto.

It is a further advantage of this invention that externally powered controls are not required to disengage a rudder vane approaching a generally horizontal orientation.

It is yet a further feature of this invention that the rudder assembly is readily adaptive to externally powered controls for the locking and unlocking of the rudder vanes for rotative movement thereof about its support arm so that reliance on gravity to move the restraining member is not required.

It is a further object of this invention to provide a rudder assembly that is effective to efficiently steer a sailing vessel while it is tipped sideways.

It is still a further object of this invention to provide a rudder assembly that can be used on sailing vessels of any size, including models.

It is yet a further object of this invention to provide a rudder assembly effective to steer a sailing vessel while it is tipped sideways which is durable in construction, inexpensive of manufacture, carefree of maintenance, facile in assemblage, and simple and effective in use.

These and other objects, features and advantages are accomplished according to the instant invention by providing a rudder assembly for use on a sailing vessel wherein the rudder is bifurcated into a pair of downwardly diverging rudder vanes rotatably mounted on support arms extending transversely of the tiller post. As the sailing vessel is tipped sideways, one of the rudder vanes approaches a generally vertical orientation while the other rudder vane approaches a generally horizontal orientation. A restraining member is pivotally mounted on a mounting post affixed to the tiller post for movement therewith and is engageable with the rudder vanes to restrict movement thereof away from a stop member. The restraining member is pivotally movable by gravity to disengage the rudder vane approaching a horizontal orientation and permit rotative movement thereof away from the stop member so that a rotation of the tiller post to turn the rudder into the direction the sailing vessel is tipped sideways will not create forces that tend to further tip the sailing vessel, leaving the rudder vane approaching a vertical orientation operable to steer the sailing vessel.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENT

Figure 1:
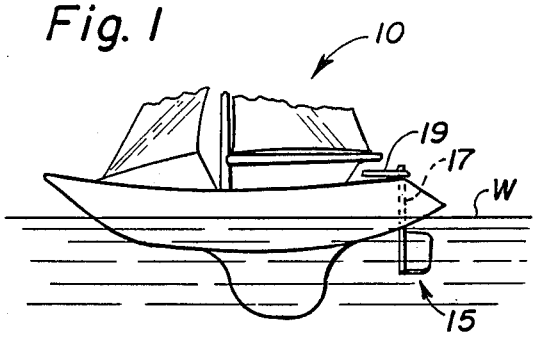
FIG. 1 is a schematic side elevational view of a sailing vessel having mounted thereon a rudder assembly incorporating the principles of the instant invention.
Figure 2:
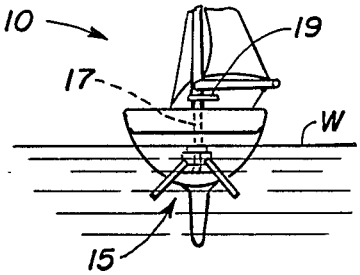
FIG. 2 is a schematic rear elevational view of the sailing vessel depicted in FIG. 1.
Figure 3:
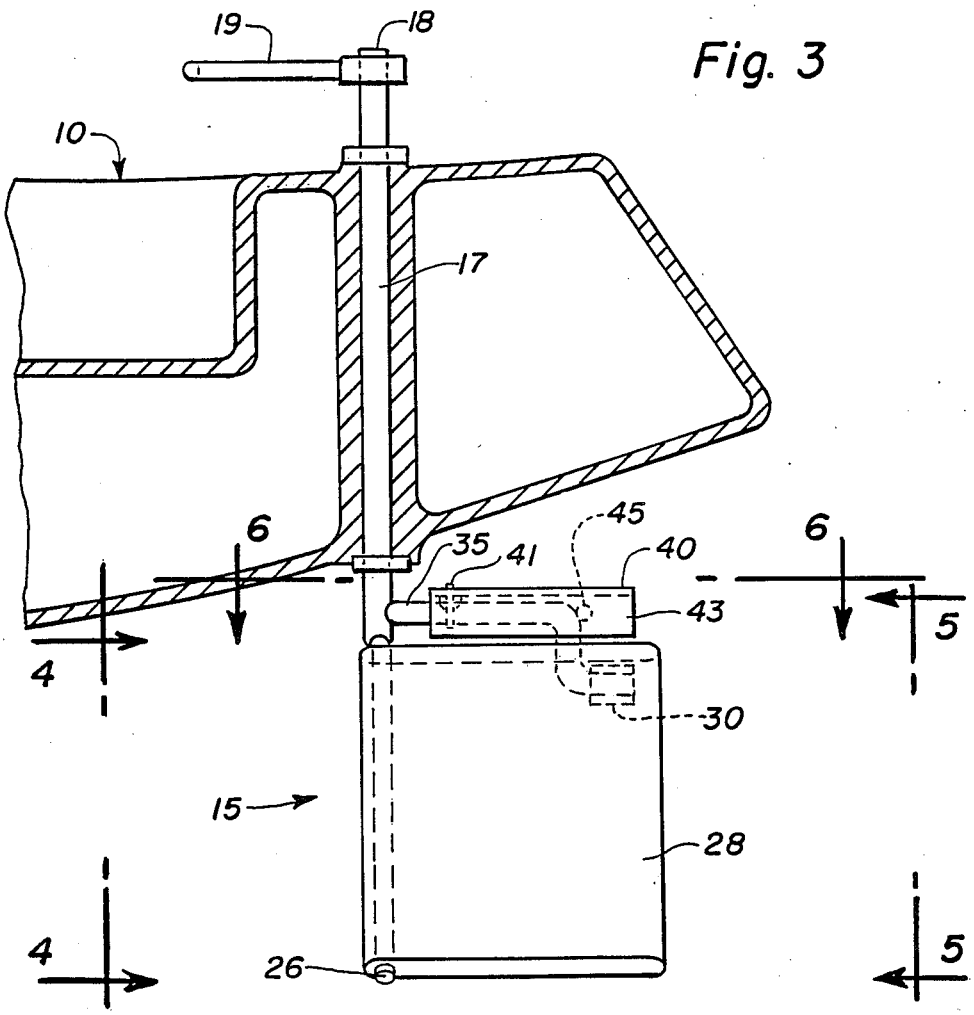
FIG. 3 is an enlarged cross-sectional view of the rear of the sailing vessel shown in FIG. 1 showing the rudder assembly affixed to a tiller post rotatably journaled in the vessel to effect a turning of the rudder assembly to change the direction of travel of the vessel, the rudder assembly is depicted with the sailing vessel in an upright orientation.
Figure 4:
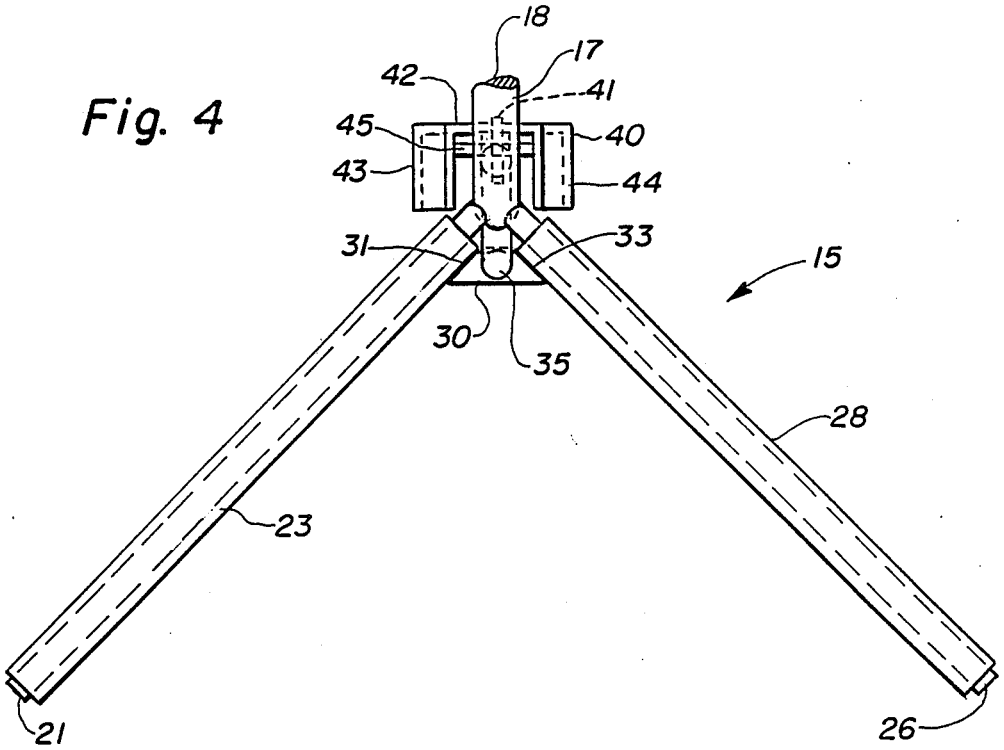
FIG. 4 is a front elevational view of the rudder assembly taken along lines 4—4 in FIG. 3 with the tiller post being broken away.
Figure 5:
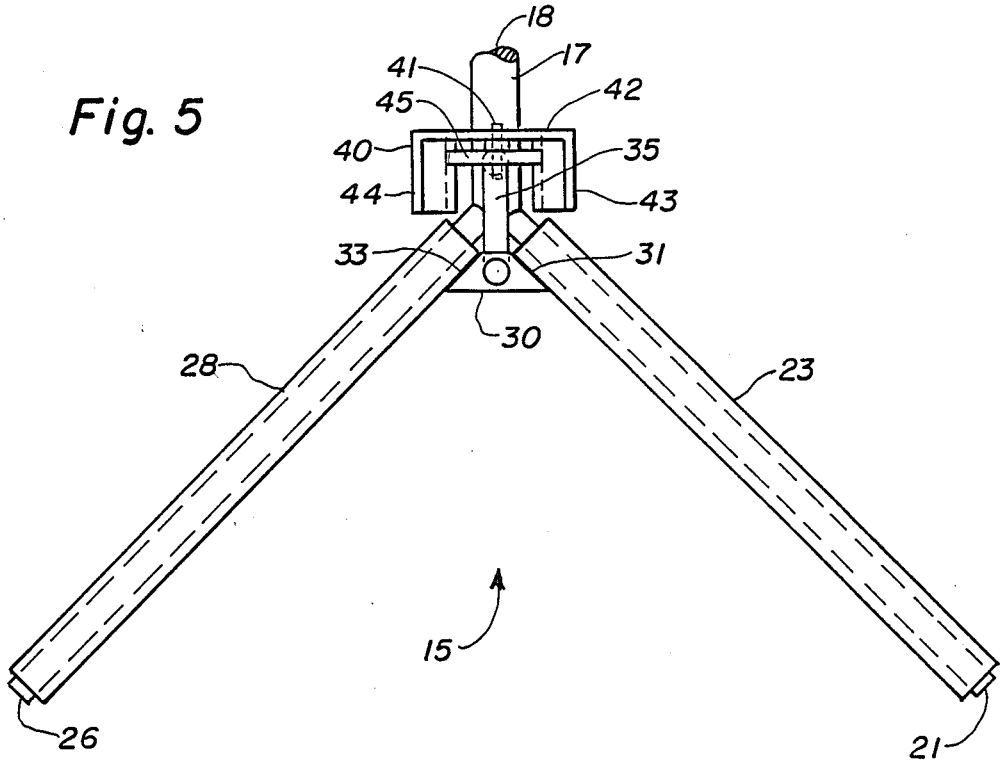
FIG. 5 is a rear elevational view of the rudder assembly taken along lines 5—5 of FIG. 3 with the tiller post being broken away.
Figure 6:
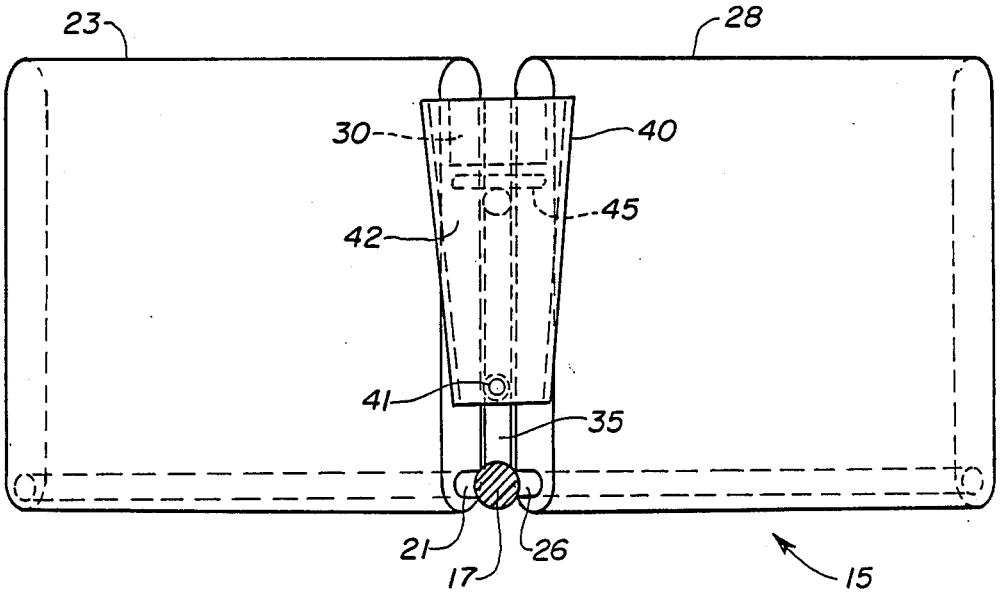
FIG. 6 is a cross-sectional view of the rudder assembly taken along lines 6—6 of FIG. 3 showing a top plan view of the rudder assembly with the sailing vessel in an upright position.

Referring now to the drawings and, particularly, to FIGS. 1 and 2, a representative sailing vessel incorporating the principles of the instant invention can be seen. The sailboat 10 is schematically shown as being of the type powered solely by the wind and using a rudder assembly 15 mounted on a tiller post 17 and operable through a steering mechanism 19 to rotate the rudder assembly 15 to deflect water in a customary manner to create forces for at least partially steering the course of travel of the sailboat 10. The sailboat 10 sits in the water with the water level W being above the rudder assembly 15.

Referring now to FIGS. 3–6, the details of the rudder assembly 15 can best be seen. The tiller post 17 is rotatably journaled in the rear of the sailboat 10 and is rotatably controlled through a steering mechanism 19 shown in the form of a tiller handle. One skilled in the art will readily realize that other forms of the steering mechanism 19 and of the tiller post 17 would be equally applicable to the instant invention without departing from the scope of the invention as will be described in greater detail below. The tiller post 17 defines an upright axis 18 about which the rudder assembly 15 is rotated. This upright axis 18 can be tipped transversely when the sailboat 10 is itself tipped sideways, such as will occur when the sailboat 10 is tacking back and forth into the wind or, more particularly, on a beam reach in which the wind is blowing perpendicularly to the direction of travel of the sailboat 10.

The rudder assembly 15 includes a pair of support arms 21, 26 which are affixed to the tiller post 17 to be rotatable therewith about the upright axis 18. The support arms 21, 26 extend transversely of the tiller post 17/upright axis 18 and diverge downwardly away from the tiller post 17 at an angle of about 45 degrees to the line of the upright axis 18. This angle of inclination should be in the range of 30 to 50 degrees, with 45 degrees being preferred, to provide proper positioning of the rudder vanes upon a sideways tipping of the boat as is described in greater detail below.

Each support arm 21, 26 has mounted thereon a rudder vane 23, 28, respectively, which are rotatable about the corresponding support arm 21, 26. Each rudder vane 23, 28 extends rearwardly from the corresponding support arm 21, 26 in an orientation that is parallel with the direction of travel of the sailboat 10 when the rudder assembly 15 is in a nominal nonturning position as depicted in FIGS. 2–6. Preferably, the rudder vanes 23, 28 will be constructed so as to be nearly buoyant. As one skilled in the art will readily realize, the rudder assembly 15 in the aforementioned nominal non-turning position permits the water to pass thereby without deflection and the resultant creation of turning forces.

The rudder assembly 15 also includes a stop member 30 mounted on the end of a mounting post 35 affixed to the tiller post 17 to be rotatable therewith. The mounting post 35 is largely positioned above the rudder vanes 23, 28 for reasons that will be described in greater detail below, but is bent to position the stop member 30 between the rudder vanes 23, 28 at a location spaced rearwardly from the support arms 21, 26. The stop member 30 includes a first sloped surface 31 against which the first rudder vane 23 is engageable and a second sloped surface 33 against which the second rudder vane 28 is engageable. The primary purpose of the stop member 30 is to prevent each respective rudder vane 23, 28 from moving into the path of travel of the other rudder vane 23, 28. Furthermore, the stop member 30 is positioned so that the sloped surfaces 31, 33 are engaged with the corresponding rudder vanes 23, 28 when the rudder vanes 23, 28 are oriented parallel to the direction of travel of the sailboat 10 when the rudder assembly 15 is in the aforementioned nominal non-turning position and the sailboat 10 is upright.

The rudder assembly 15 also includes a restraining member 40 pivotally supported on the mounting post 35 by a pivot pin 41. The restraining member 40 has an inverted U-shaped cross-sectional configuration with a flat bight portion 42 connected to the pivot pin 41 and a pair of downwardly projecting legs 43, 44. The legs 43, 44 diverge rearwardly and are positioned to be engageable with the rudder vanes 23, 28 by intersecting the path of movement thereof above the stop member 30. The restraining member 40 is pivotally movable in a plane generally perpendicular to the line of the upright axis 18 between a restraining position and a non-restraining position.

Figure 7:
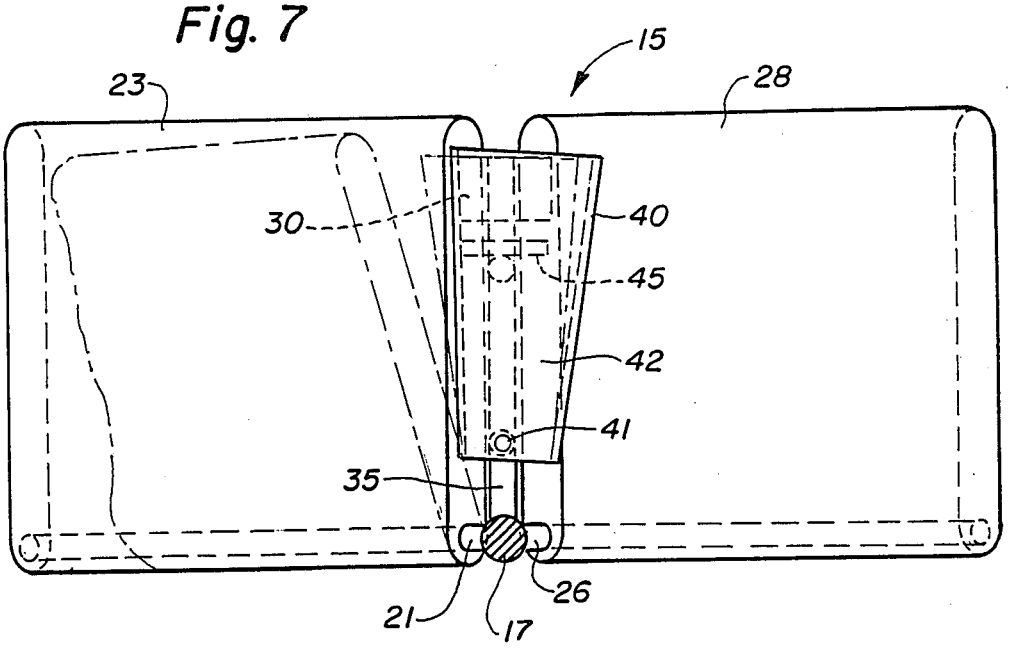
FIG. 7 is a cross-sectional view of the rudder assembly similar to the view of FIG. 6 except that the sailing vessel is tipped sideways, the rotational movement of the rudder vane approaching a generally horizontal orientation being shown in phantom as is the pivotal movement of the restraining member.
Figure 8:
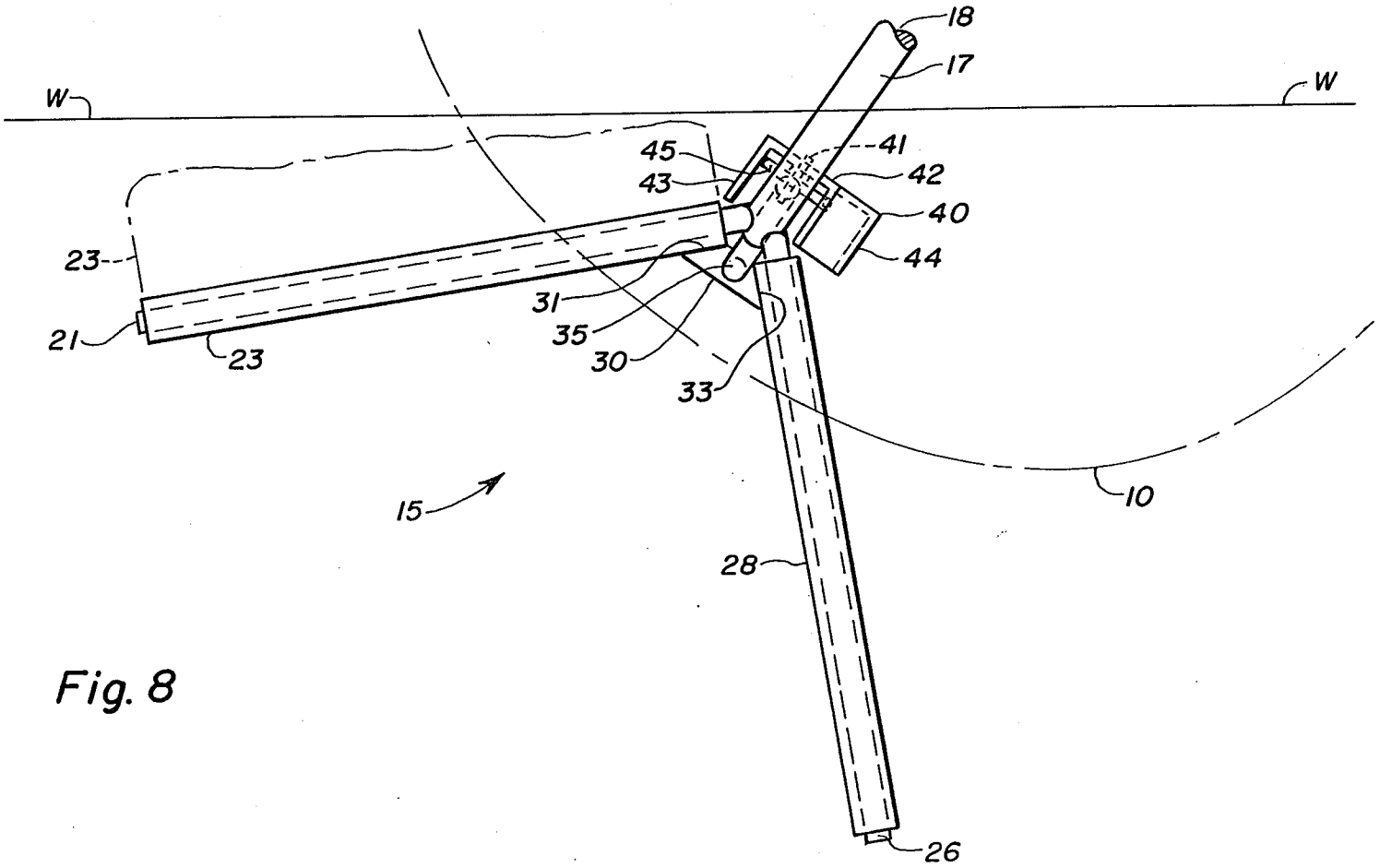
FIG. 8 is a front elevational view of the rudder assembly shown in FIG. 7 with the tiller post being broken away, the representative outline of the foreground hull of the sailing vessel being shown in broken lines and the rotative movement of the rudder vanes being shown in phantom.

When the restraining member 40 is in a restraining position with respect to either of the rudder vanes 23, 28, that particular rudder vane 23, 28 is prevented from moving away from the stop member 30 due to the interference between the respective leg 43, 44 and the path of movement of that rudder vane 23, 28. When the restraining member 40 is in a non-restraining position with respect to either of the rudder vanes 23, 28, the restraining member 40 has pivotally moved so that the corresponding leg 43, 44 is no longer within the path of travel of that particular rudder vane 23, 28. Since the legs 43, 44 diverge rearwardly, the restraining member 40 can be in the restraining position with respect to both rudder vanes 23, 28, simultaneously, as is the case when the sailboat 10 is upright. The non-restraining position for the restraining member 40 is depicted in FIGS. 7 and 8 and will be operationally described in greater detail below. The mounting post 35 is provided with a limiting bar 45 positioned beneath the bight portion 42 of the restraining member 40 and between the legs 43, 44. The function of the limiting bar 45 is to restrict the pivotal movement of the restraining member 40 as will also be described below.

When the sailboat 10 is in a nominal upright position shown in FIGS. 1 and 2, maintaining the upright axis 18 in a generally vertical orientation, the manipulation of the steering mechanism 19 to rotate the tiller post 17 and the attached rudder assembly 15 causes the rudder assembly 15 to turn about the upright axis 18 so that the rudder vanes 23, 28 are positioned obliquely to the flow of water passing thereby. The obliquely oriented rudder vanes 23, 28 cause a customary deflection of the water and the creation of the forces required to change the direction of travel of the sailboat 10. The rudder vanes 23, 28 cannot rotate about the corresponding support arms 21, 26 by reason that the restraining member 40 is in a restraining position with respect to both rudder vanes 23, 28, trapping the rudder vanes 23, 28 between the stop member 30 and the respective legs 43, 44 of the restraining member 40. The result is that the combined obliquely oriented rudder vanes 23, 28 operate as a typical rudder to change the direction of travel of the sailboat 10.

It should be noted, however, that turning of the rudder as noted above to steer the sailboat 10 will orient the restraining member 40 obliquely to the flow of water. Since the restraining member 40 is free to rotate unimpeded about the pivot pin 41 on which it is mounted, the force of the flow of water will effect a pivoting of the restraining member 40 to an equlibrium position relative to the water flow. As a result, one of the rudder vanes 23, 28 will be freed for rotation about the corresponding support arm 21, 26, while the other rudder vane 23, 28 will be restrained from rotation between the restraining member 40 and the stop member 30. However, since the force of the water creating turning forces against the obliquely oriented rudder assembly 15 pushes the unlatched rudder vane 23, 28 against the stop member 30, the rudder assembly 15 is fully operable to efficiently effect a steering of the sailboat 10 with both rudder vanes 23, 28 creating turning forces.

A sideways tipping of the sailboat 10 will effect a corresponding sideways tipping of the upright axis 18 into a non-vertical orientation. The resultant effect on the rudder assembly 15 is depicted in FIGS. 7 and 8. The weighted restraining member 40 pivots due to gravitational forces about the pivot pin 41 to move into a non-restraining position with respect to the rudder vane 23 which is moving toward a generally horizontal orientation because of the sideways tipping of the sailboat 10. Since the leg 43 of the restraining member 40 is free of the path of movement of the rudder vane 23, the rudder vane 23 is permitted to move away from the stop member 30 by rotating about the corresponding support arm 21. The pivotal movement of the restraining member 40 is limited by the limiting bar 45 to the position best seen in FIG. 8 where the leg 43 is just barely clear of the rudder vane 23.

The pivotal movement of the restraining member 40 as depicted in FIGS. 7 and 8 places the other leg 44 further into the path of movement of the other rudder vane 28, thereby maintaining the restraining member 40 in the restraining position with respect to the rudder vane 28 which is approaching a generally vertical orientation due to the sideways tipping of the sailboat 10. Accordingly, the rudder vane 28 is not free to rotate about the support arm 26 as it is trapped between the restraining member 40 and the stop member 30.

A subsequent turning of the tiller post 17 when the upright axis 18 is in a non-vertical orientation as depicted in FIGS. 7 and 8 will effect a rotation of the rudder vane 28 approaching a vertical orientation, since the restraining member 40 is in a restraining position relative thereto, to deflect the flow of water and cause the forces necessary to effect a turning of the sailboat 10 even though it is tipped sideways. More importantly, a turning of the steering mechanism 19 to turn the sailboat 10 away from the direction the sailboat is tipped, e.g. a turning to the right when the sailboat is tipped to the left as shown in FIG. 8 (To avoid confusion between left and right references, it must be remembered that FIG. 8 is a front elevational view of the rudder assembly 15 and that the outline of the hull of the boat 10 is in the foreground of the rudder assembly 15 and not in the background.), will cause the stop member 30 to engage the rudder vane 23 and deflect the rudder vane 23 upwardly into the flow of water. This upward deflection of water by the rudder vane 23 creates a force through the rudder assembly 15 that will tend to right the sailboat 10 toward the aforementioned nominal upright position.

Conversely, a turning of the steering mechanism 19 to turn the sailboat 10 in the same direction as the sailboat 10 is tipped, e.g. to the left as depicted in FIG. 8, will likeways effect a turning of the generally vertical rudder vane 28 to steer the sailboat 10, but will instead permit the generally horizontal rudder vane 23 to flow with the flow of the water and thereby separate from the stop member 30 because the restraining member 40 is in a non-restraining position relative to the rudder vane 23. As a result, the attempt to turn the sailboat 10 into the direction the sailboat 10 is tipped will not create a force operable through the rudder assembly 15 to tend to further tip the sailboat 10 in the aforementioned sideways direction.

The ultimate return of the sailboat 10 to a generally upright orientation will result in the restraining member 40 pivoting on the pivot pin 41 back into the position shown in FIGS. 2–6 with the restraining member 40 in a restraining position with respect to both of the rudder vanes 23, 28. Should the restraining member 40 attempt to pivotally move while the rudder vane 23 is still separated from the stop member 30, the leg 43 will be prevented from further pivotal movement by the rudder vane 23 until the rudder vane 23 has reengaged with the sloped surface 31 of the stop member 30. The rearwardly diverging shape and the inverted U-shaped configuration of the restraining member 40 provides a self-centering restraining member 40 due to the flow of water passing thereby.

Should the restraining member 40 be pivoted back into a restraining position with respect to a rudder vane 23, 28 that has for some reason remained pivoted on the corresponding support arm 21, 26 away from the stop member 30, a subsequent movement of that rudder vane 23, 28 toward the stop member 30 will cause a pivoting of the restraining member 40 to permit that rudder vane 23, 28 to move into position against the stop member 30 whereupon the restraining member 40 will be free to return to the restraining position to trap that rudder vane 23, 28 against the stop member 30 as noted above. As a result, the rudder vane 23, 28 will be relatched in its operative position without the need for action from the operator of the boat 10.

One skilled in the art will readily see that this bifurcated rudder assembly 15 has the advantage of providing a means for changing the direction of travel of the sailboat 10 when it is in a generally upright orientation, yet is operable to create forces to help right the sailboat 10 when the steering mechanism 19 is manipulated to turn the sailboat 10 in the direction opposite to the direction the sailboat 10 is tipped, without creating forces tending to further tip the sailboat 10 upon the opposite turning of the steering mechanism 19. With prior art fixed vertical rudders, a sideways tipping of the sailboat 10 would result in forces to either help right or to further tip the sailboat 10, depending on which direction the sailboat 10 was manipulated to turn. It has been found that the above-described rudder assembly 15 has been particularly effective on radio actuated, remotely controlled model sailboats.

Alternative embodiments of various components of the rudder assembly 15 described above will also be appreciated by one skilled in the art within the principles and scope of the invention. For example, alternative configurations of the support structure for mounting the rudder vanes 23, 28 and the restraining member 40 could include a frame member that lies between the rudder vanes 23, 28 to act as a stop member limiting the rotation of the rudder vanes 23, 28 into the path of the other rudder vane 23, 28, while the restraining member is pivotally mounted on a bracket or other associated frame member. Furthermore, the restraining member 40 could be configured in a number of other shapes, such as a relatively flat triangularly shaped member; as a trapezoidally shaped boxlike beam; as a wire framework; or as a notched beam cooperable with an upwardly projecting limiting bar, as representative examples. The primary purpose of the restraining member 40 is to interfere with the rotational movement of the rudder vanes 23, 28, yet be pivotally movable to clear the path of movement of a rudder vane moving toward a horizontal orientation whenever the boat 10 tips sideways.

One skilled in the art will further realize that the above-described rudder assembly 15 is adaptive to externally powered controls for effecting the control of the rotation of the rudder vanes 23, 28 about the corresponding support arm 21, 26, rather than relying on gravitation to pivotally move the restraining member. For example, each rudder vane 23, 28 could be provided with an alternative rotational lock operatively associated with a microprocessor or the like to sense the actual orientation of the rudder vane 23, 28 and either lock or unlock the rotative movement thereof according to the optimum angle at which the rudder vane should be freed for rotation for that particular application or vessel. Such alternative embodiments are intended to be within the principle and scope of the invention.

It will be understood that changes in the details, materials, steps and arrangement of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description may be employed in other embodiments without departing from the scope of the invention.

Having thus described the invention, what is claimed is:

1. A rudder assembly for use on a marine vessel having a steering mechanism operatively associated with said rudder assembly to control movement thereof, comprising:

first and second support arms affixed to said steering mechanism to permit movement therewith about a turning axis, said support arms extending angularly with respect to said turning axis in a diverging manner away from said steering mechanism; and a rudder vane movably mounted to each respective said support arm and extending outwardly therefrom in alignment with the direction of travel of said marine vessel when positioned in a nominal upright position, said rudder vanes being operable to deflect water when turned about said turning axis by said steering mechanism, thereby changing the direction of travel of said marine vessel until said rudder assembly is returned to said nominal upright position, said rudder vanes being movable relative to each other.

2. The rudder assembly of claim 1 wherein each said rudder vane is journelled on the corresponding said support arm for movement thereof about an axis defined by each respective said support arm, said rudder assembly further including a control mechanism for controlling the rotative movement of each said rudder vane about the corresponding support arm.

3. The rudder assembly of claim 2 wherein said control mechanism includes a stop to limit the, rotative movement of each respective said rudder vane in a first direction toward said stop beyond a preselected position.

4. The rudder assembly of claim 3 wherein said control mechanism further includes a movable restraining member operatively associated with each said rudder vane to restrict movement thereof in a second direction away from said stop and opposite to said first direction, said restraining member being cooperable with said stop to restrain each said rudder vane from substantially any rotative movement thereof about the corresponding said support arm.

5. The rudder assembly of claim 4 wherein said restraining member is movable with respect to each respective rudder vane between a restraining position in which the respective rudder vane is restricted from moving in said second direction and in a non-restraining position in which the respective rudder vane is free to move in said second direction away from said stop which will limit the movement of said respective rudder vane in said first direction beyond said preselected position.

6. The rudder assembly of claim 5 wherein said restraining member is moved into said non-restraining position with respect to one of said rudder vanes whenever the support arm corresponding to said one rudder vane is positioned generally horizontally by a sideways tipping of said marine vessel, said restraining member remaining in said non-restraining position until said corresponding support arm is returned to a position below said substantially horizontal position by an uprighting of said marine vessel.

7. The rudder assembly of claim 6 wherein said restraining member is pivotally connected to a mounting post extending perpendicularly to said turning axis.

8. The rudder assembly of claim 7 wherein said mounting post also extends perpendicularly to a plane passing through said support arms, said plane also passing through said turning axis.

9. The rudder assembly of claim 8 wherein said restraining member is pivotally movable by gravity so that a sideways tipping of said turning axis caused by a corresponding movement of said marine vessel effects a pivotal movement of said restraining member to move into said non-restraining position with respect to the one of said rudder vanes being moved into said substantially horizontal position while remaining in said restraining position with respect to the other said rudder vane.

10. The rudder assembly of claim 9 wherein said restraining member has first and second opposing sides positioned in interference with the rotative movement of a corresponding said rudder vane when said restraining member is in a restraining position relative thereto.

11. The rudder assembly of claim 10 wherein said first and second sides diverge rearwardly away from said steering mechanism so that said restraining member can be in a restraining position with respect to both of said rudder vanes when said turning axis is substantially vertical.

12. The rudder assembly of claim 11 wherein said stop is affixed to said mounting post and is positioned between said rudder vanes to prevent movement of each respective said rudder vane into the path of movement of the other said rudder vane.

13. The rudder assembly of claim 12 wherein said support arms are oriented at an angle in the range of 30 to 50 degrees with respect to said turning axis.

14. The rudder assembly of claim 13 wherein said turning axis is defined by a tiller post journaled for movement about an upright axis relative to said marine vessel, said first and second support arms and said mounting post being affixed to said tiller post for rotative movement therewith.

15. The rudder assembly of claim 11 wherein said marine vessel is a model sailboat.

16. In a sailing vessel having a steering mechanism operatively controlling a rearwardly positioned rudder assembly operable to deflect water to create turning forces to change the direction of travel of said sailing vessel, said steering mechanism being operable to rotate said rudder assembly about a normally upright turning axis, said sailing vessel being operable to tip sideways causing said turning axis to move into a non-vertical orientation, an improved rudder assembly comprising:

first and second support arms extending angularly with respect to said turning axis and diverging downwardly away from said turning axis, said support arms being connected to said steering mechanism for rotative movement about said turning axis, said support arms and said turning axis lying in a common plane oriented generally perpendicularly to the direction of travel of said sailing vessel when said rudder assembly is in a nominal non-turning position;

a rudder vane mounted on each said support arm for rotative movement about an axis defined by each respective said support arm, each said rudder vane extending rearwardly from the corresponding said support arm for alignment parallel with the direction of travel of said sailing vessel when said rudder assembly is in said nominal non-turning position; and a control mechanism operatively associated with both said rudder vanes to control the rotative movement of said rudder vanes about said support arms, said control mechanism being operable to restrict the rotative movement of both said rudder vanes when said turning axis is substantially upright and to free for limited rotative movement the rudder vane being elevated toward a generally horizontal position by a corresponding sideways tipping of said sailing vessel.

17. The sailing vessel of claim 16 wherein said control mechanism includes a fixed stop member positioned between said rudder vanes to prevent each said rudder vane from moving into the path of movement of the other said rudder vane.

18. The sailing vessel of claim 17 wherein said control mechanism further includes a movable restraining member operatively associated with said rudder vanes to restrict movement of each respective said rudder vane away from said stop member, said restraining member being movable with respect to each said rudder vane between a restraining position in which the respective rudder vane is restrained from any substantial movement away from said stop member and a non-restraining position in which said respective rudder vane is permitted to rotate about the corresponding support arm limited only by said stop member, said restraining member moving into said non-restraining position with respect to one of said rudder vanes when said one rudder vane is elevated toward a generally horizontal orientation by a corresponding sideways tipping of said sailing vessel.

19. The sailing vessel of claim 18 wherein said restraining member is pivotally connected to a mounting post extending rearwardly from and generally perpendicularly to said common plane, said mounting post being rotatable with said support arms by said steering mechanism.

20. The sailing vessel of claim 19 wherein said restraining member is pivotally movable by gravity so that a sideways tipping of said sailing vessel to move said turning axis into a non-vertical orientation effects a pivotal movement of said restraining member into said non-restraining position with respect to the one of said rudder vanes moving toward a horizontal position, said pivotal movement of said restraining member maintaining said restraining position with respect to the other of said rudder vanes moving toward a vertical orientation.

21. The sailing vessel of claim 20 wherein said restraining member has a pair of rearwardly diverging legs defining the sides of said restraining member and being respectively operable to interfere with the movement of said rudder vanes away from said stop member when in said restraining position, said legs being operable to restrict movement of both said rudder vanes when said turning axis is generally vertically oriented.

22. The sailing vessel of claim 21 wherein said support arms are oriented generally perpendicularly with respect to each other and at an angle of approximately 45 degrees with respect to said turning axis.

23. A rudder assembly mounted on a sailboat for controlling the direction of travel of the sailboat comprising:

a tiller post journaled for rotative movement in said sailboat, said tiller post having a generally upright orientation when said sailboat is in a nominal upright position, said tiller post being positioned in a non-upright orientation when said sailboat tips sideways;

first and second support arms affixed to said tiller post for rotative movement therewith, said support arms diverging downwardly from said tiller post and extending transversely of said tiller post such that a movement of said tiller post into a non-upright orientation effects a corresponding movement of one of said support arms toward a horizontal orientation and of the other said support arm toward a vertical orientation;

first and second rudder vanes rotatably mounted, respectively, on said first and second support arms to be rotatable about an axis defined by each respective support arm;

a stop member positioned between said rudder vanes to limit the rotative movement of said rudder vanes so that each said rudder vane is prevented from moving into the path of movement of the other said rudder vane; and a restraining member pivotally connected to a mounting post affixed to the tiller post to be rotatable therewith, said restraining member being pivotally movable between a restraining position in which said restraining member interferes with the movement of the respective said rudder vane away from the stop member and a non-restraining position in which said restraining member is clear of the path of movement of the respective said rudder vane so that said respective rudder vane is free to rotate about the corresponding said support arm away from said stop member, said restraining member being movable from said restraining position to said non-restraining position only when the respective said rudder vane and corresponding said support arm are approaching said horizontal position due to a sideways tipping of said sailboat.

24. The rudder assembly of claim 23 wherein said support arms extend generally perpendicularly with respect to each other and at an angle in the range of 30 to 50 pk degrees with respect to a generally vertical orientation.

25. The rudder assembly of claim 24 wherein said restraining member is pivotally movable between said restraining position and said non-restraining position by gravity.

26. The rudder assembly of claim 25 wherein said restraining member has a pair of legs diverging away from said tiller post and being engageable with said first and second rudder vanes, respectively, when said restraining member is in said restraining position to prevent any substantial movement of the corresponding said rudder vane away from said stop member, the corresponding said leg being moved free of the path of movement of the corresponding said rudder vane while the other said leg remains in an interfering position relative to the path of movement of the other said rudder vane when said restraining member pivots to a non-restraining position relative to the rudder vane approaching a horizontal position.

* * * * *